United States Patent [19]

Andrews et al.

[11] 3,987,729

[45] Oct. 26, 1976

[54] DEVICE FOR FIRING AN ELECTRIC DETONATOR

[75] Inventors: Jeremy Charles Andrews, Salcoats; Gordon Brian Roger Shannon, Dundonald, both of Scotland

[73] Assignee: Imperial Chemical Industries Limited, London, England

[22] Filed: Oct. 15, 1974

[21] Appl. No.: 515,017

[30] Foreign Application Priority Data

Oct. 31, 1973 United Kingdom ..... 50605/73

[52] U.S. Cl. ..... 102/22 R; 102/16; 102/28 R; 102/70.2 GA; 310/8.7

[51] Int. Cl.[2] ..... F42B 3/12; F42C 11/02

[58] Field of Search ..... 102/7, 10, 16, 20, 21, 102/21.6, 22, 23, 70.2 GA; 310/8.4, 8.7

[56] References Cited

UNITED STATES PATENTS

| | | | |
|---|---|---|---|
| 2,917,642 | 12/1959 | Wright et al. | 310/8.7 |
| 2,961,507 | 11/1960 | Higgs | 102/16 |
| 3,166,684 | 1/1965 | Williams et al. | 310/8.7 |
| 3,320,890 | 5/1967 | Ciccone et al. | 102/70.2 GA |

*Primary Examiner*—Verlin R. Pendegrass
*Attorney, Agent, or Firm*—Cushman, Darby & Cushman

[57] ABSTRACT

A device for firing an electric detonator which comprises a pressure deformable sealed waterproof housing containing an electric energy source for ignition of a detonator and means responsive to the deformation of the housing for actuating the energy source. The housing preferably comprises a bellows element and the energy source is preferably a piezoelectric element. The device is useful for multiple shot blasting wherein one explosive charge is initiated by the shock wave from a previously exploded charge.

5 Claims, 2 Drawing Figures

DEVICE FOR FIRING AN ELECTRIC DETONATOR

Figure 1:
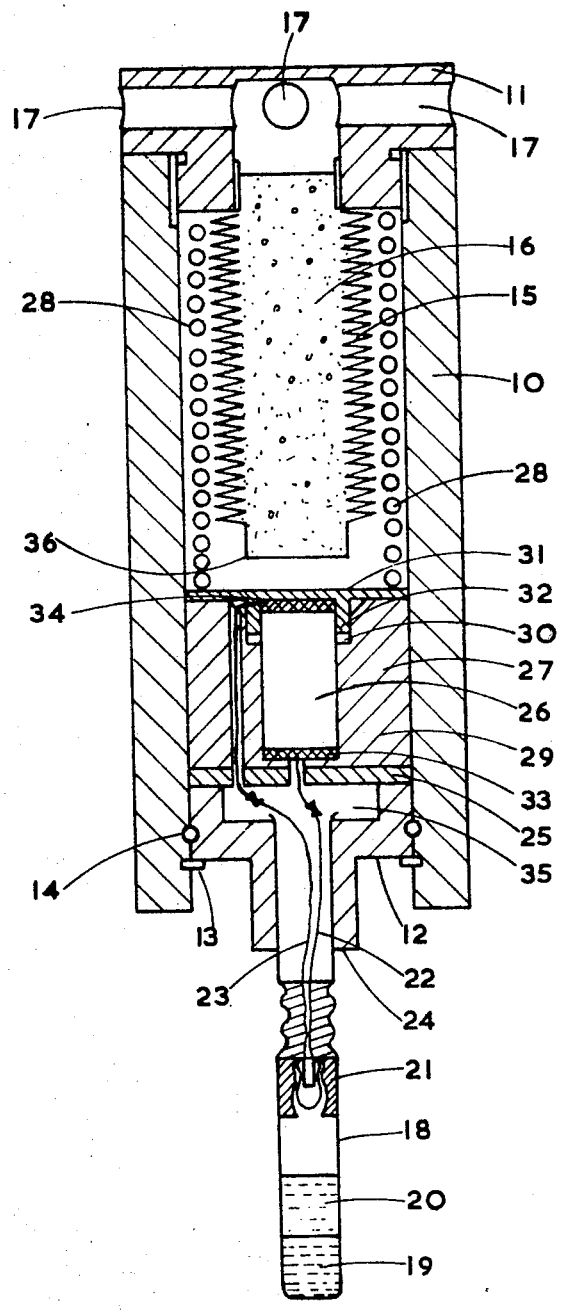

This invention relates to a pressure-actuated device for firing an electric detonator whereby the detonators of a plurality of spaced apart blasting charges may be fired in one blasting round, to a detonator assembly comprising the said device and to a method of blasting using the said device. The method is especially useful for underwater blasting.

In underwater blasting operations such as the removal of rock from the seabed for channel and harbour deepening operations, the usual practice is to place charges at spaced intervals either on the seabed or in boreholes therein and fire the charges. In some operations the sensitivity of the explosive used and the spacing are chosen so that only one charge need be fired with a detonator, the remaining charges being initiated by sympathetic detonation. This method requires very sensitive explosives which are undesirably dangerous for handling on a vessel at sea, and it is more usual, therefore, to initiate each charge by its own initiator which may be an electric blasting detonator or a plain detonator with a transmission line of detonating cord. This involves long connecting lines of electric wires or detonating cord between a surface blasting station and the placed charges, and these lines are difficult to maintain in position without becoming entangled and confused. With electric leading wires, misfires may result from misconnection to the energy source and premature ignitions may result from extraneous electricity such as lightning or electromagnetic radiation. With detonating cord, misfires may result from fouling of the cord lengths giving detonation 'cut-off' in some of the cord lengths.

In order to avoid leading a wire or detonating cord from each charge to the surface, blasting systems have been proposed wherein the charges have been primed with percussion sensitive detonators which were designed to be ignited by the shock wave transmitted through the water from a previously exploded charge. In a further system, the charges have been primed with detonators which were adapted to be initiated by an ultrasonic signal transmitted through the water. These so-called 'wireless' systems have not found favour with blasting operators for various reasons including, in the former case, the hazard of using percussion detonators in stormy sea conditions and, in the latter case, the expense of the equipment involved.

It is an object of this invention to provide an improved means for detonating a plurality of charges in a blasting round which does not require electric wires or ignition transmission lines between the individual blasting charges or from the charges to a firing station.

We have now devised a detonator firing device for multiple shot blasting wherein the movement of an element moving in response to shock wave pressure from a detonating charge is used to establish an electrical firing current through an electrical ignition element of a detonator for firing a further explosive charge with which the detonator is in contact.

In accordance with this invention, a device for firing an electric detonator comprises a sealed waterproof housing having a wall portion deformable in response to external pressure on the housing, an electrical energy source within the said housing and adapted for connection in circiut with the electric ignition element of an electric blasting detonator and means responsive to the deformation of the housing to actuate the electrical energy source to supply ignition energy to the said ignition element when the ignition element is connected to the said energy source. In operation, the device is located in a pressure transmitting medium through which a shock wave from an exploding charge is transmitted, and the shock wave pressure causes deformation of the deformable wall portion of the housing, which deformation fires an electric detonator coupled to the device.

The deformable wall portion of the housing is conveniently provided as a diaphragm and in the preferred form comprises a bellows element which preferably extends into the housing. A bellows element is especially advantageous as it may be arranged to provide an arming system for the device. Thus, the base of the bellows may be off-set from the actuating means for the electrical energy source so that it does not become displaced sufficiently in normal handling to actuate the energy source. The interior of the bellows element is preferably filled with a liquid, which is preferably a gelled liquid, in order to increase the rate of response of the element to a shock wave.

The electrical energy source may comprise an electric cell, in which case the means to actuate the energy source is conveniently a switch adapted for operation by the deformation of the housing. However, in an especially advantageous device, the electrical energy source comprises a piezoelectric transducer element which may be adapted to fire an electric detonator directly or through a capacitor and the actuating means comprises means to compress the piezoelectric element. The piezoelectric element is advantageously disposed between an anvil element connected to the housing and a hammer element connected to the deformable portion of the housing whereby, when the housing is subjectd to external shock wave pressure, the piezoelectric element is compressed and a voltage is generated between the opposed faces of the piezoelectric element adjacent to the anvil element and the hammer element respectively, the said opposed faces of the piezoelectric element being provided with electrodes adapted for connection in circuit with the ignition element of an electric detonator. The hammer element may conveniently be provided as the base of a bellows member. The preferred piezoelectric element is a piezoelectric ceramic element, for example an element of lead zirconate titanate, barium titanate, lead metaniobate or lead strontium titanate zirconate.

The invention also includes a detonator assembly comprising an electric detonator incorporating an electric fusehead and explosive charges, in combination with the aforedescribed firing device of the invention, the electric fusehead being electrically connected in circuit with the electrical energy source of the said device. In a convenient assembly, the detonator is sealed in an aperture in the housing of the device.

The invention further includes a method of blasting wherein an electric detonator is fired by electrical energy generated by a firing device of the invention in response to a shock wave from an explosion impinging on the deformable wall portion of the housing of the device.

The device is advantageously employed in a method of blasting, wherein one or more individual charges are each primed with an electric detonator assembly of the invention and a further explosive charge is exploded sufficiently near to at least one of the said individual explosive charges to transmit to the detonator assembly a sufficiently strong shock wave to fire the electric detonator of the assembly and explode the charge. Although the further explosive charge may be a charge located in any pressure transmitting medium surrounding the detonator firing device of the assembly, it is conveniently a neighbouring charge in a multiple charge blasting round comprising the said individual explosive charges, which is fired from a remote blasting station in the usual manner.

The invention is especially advantageous in a method of underwater blasting wherein one or more blasting charges are primed with a detonator assembly of the invention and the detonator firing device is actuated by the pressure generated by the explosion of a neighbouring charge in the blasting round or an explosive charge located in the overlying water layer.

In order to illustrate the invention further, a detonator assembly and its use in an underwater blast is hereinafter described, by way of example only, with reference to the accompanying drawings wherein FIG. 1 shows the detonator assembly in axial cross-section.

Figure 2:
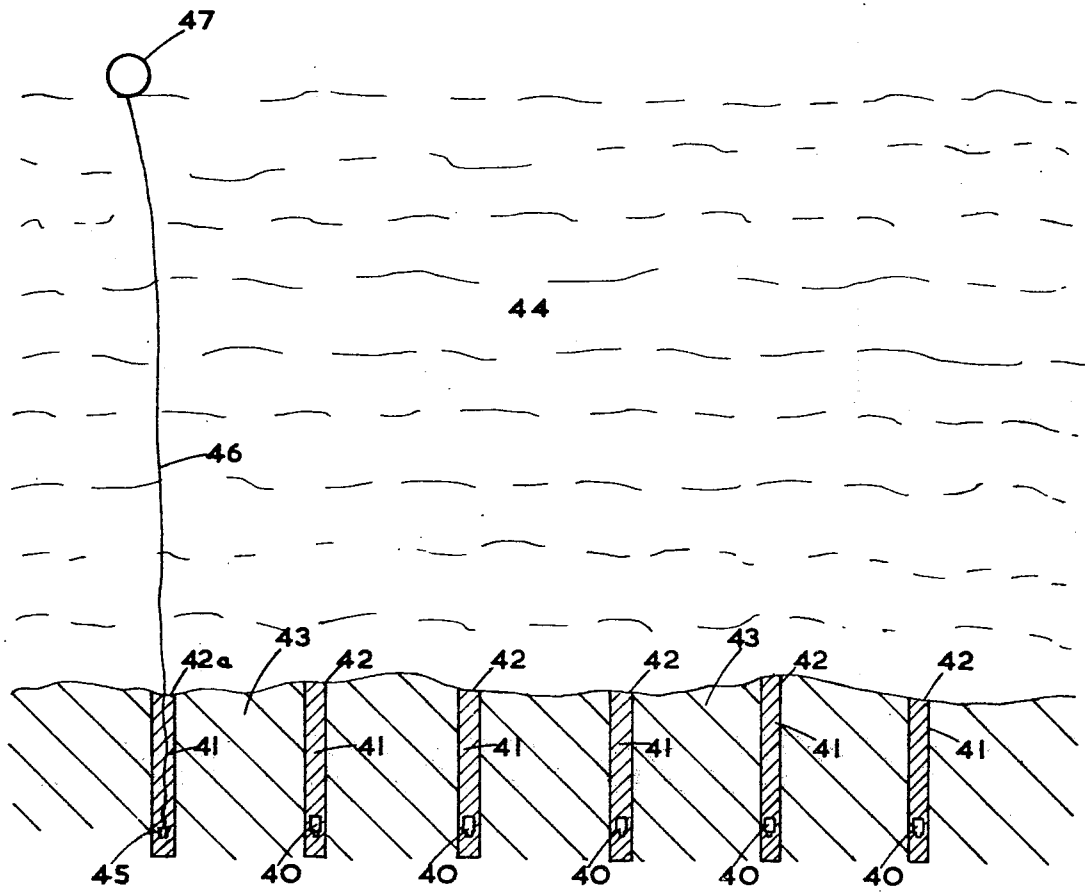

FIG. 2 shows diagrammatically an arrangement of charges in an underwater blasting round.

Referring to FIG. 1, the assembly comprises a tubular metal housing 10 having a radially perforated end cap 11 screwed into one end and an axially perforated end cap 12 retained by a circlip 13 and sealed by a rubber O-ring 14 in the other end. A metal bellows element 15 filled with an aqueous gel 16 is bonded by resin cement at its open end periphery to the end cap 11 so that the interior of the bellows element 15 is in communication with radial perforation 17 formed in the end cap 11.

An electric detonator 18, comprising a base charge 19, a primary charge 20, a silicone rubber sleeved high tension electric fusehead 21 and plastics insulated electric conductor wires 22 and 23, is bonded by a resin cement into an axial sleeve member 24 of the end cap 12.

Located within the housing 10 is a metal anvil element 25 resting on the end cap 12, and a cylindrical piezoelectric ceramic element 26 encapsulated in a hollow plastics container 27, the container being biassed against the element 25 by a spring 28 disposed between the container 27 and the end cap 11. The container 27 consists of a cylindrical hollow body member 29 having a stepped cylindrical chamber 30 closed at one end and a flexible plastics lid comprising a thin flexible disc 31 with a depending annular rim 32. The rim 32 is disposed as a sliding fit in the mouth of the chamber 30 and, in operation, acts as a guide for the disc 31. Metal disc electrodes 33 and 34 corresponding in cross-sectional dimensions to the element 26 are located one on each end of the ceramic element 26 and in direct contact therewith, and the element 26 and the electrodes are tightly encapsulated in the chamber defined by the body member 29 and the lid. The electrodes 33 and 34 are electrically connected to the conductor wires 22 and 23 respectively, the body member 29, rim 32 and the anvil element 25 being formed with narrow passages as shown to accommodate the insulated conductor wires. The inner face of the end cap 12 is formed with a recess 35 to accommodate any excess length and any joints in the wires 22 and 23 which are required to facilitate the construction of the assembly.

The base of the bellows element 15 is a flat metal disc 36 which in operation, consequent on rapid compression of the gel 16, delivers a hammer blow to the disc 31 and compresses the ceramic element 26. In assemblies which are required to be used under elevated pressure, the disc 36 is located so that at atmospheric pressure it is spaced from flexible disc 31 but, when the assembly is placed in its operative position and the bellows element 15 is extended, the disc 36 rests on disc 31. Thus, the assembly is safe from premature ignition by accidental movement of the bellows element 15 at atmospheric pressure and only becomes 'armed' when the assembly is subjected to the desired working pressure.

In constructing the assembly, the end cap 11 with the bellows element 15 attached, is screwed into one end of the housing 10 and the remaining elements are assembled from the opposite end. Conveniently the container 27, ceramic element 26 and its electrical connections are formed as one sub-assembly, the end cap 12 and detonator 18 are formed as a further sub-assembly and the insulated conductor wires of the sub-assemblies are then connected in circuit.

In use, the assembly is placed with its detonator in a blasting explosive charge and surrounded by pressure transmitting material. A pressure shock wave is generated in the pressure transmitting material and the pressure surge through the perforations 17 cause extension of the bellows element 15. The disc 36 delivers a hammer blow which compresses the ceramic element 26 against the anvil element 25. A voltage is thereby generated between the electrodes 33 and 34 and current flows in fusehead 21 whereby the fusehead is ignited and the detonator charges 19 and 20 and the blasting explosive charge are exploded.

In the underwater blasting round illustrated in FIG. 2 assemblies 40 of the invention are immersed in aqueous slurry blasting explosive charge 41 placed in drillholes 42 in the bedrock 43 under water 44, the bellows element becoming filled with slurry explosive. In a further drillhole 42*a*, the explosive charge 41 is primed with a conventional electric detonator 45 which is connected by insulated electric conductor wires 46 to an electric energy source at a remote firing station 47 above the water surface. When the detonator 45 is fired and the charge 41*a* exploded, the ensuing shockwave transmitted through the bedrock and slurry explosive causes such compression of the fluid slurry material in the bellows element of the assembly in the next adjacent explosive charge 41 that the detonator of the assembly is fired and the charge explodes. The shock wave from this explosion will subsequently be transmitted to the assembly in the next adjacent charge and this charge will be exploded. In like manner, all assemblies sufficiently near to an exploding charge to receive a sufficiently strong pressure shock wave will detonate.

What we claim is:

1. A firing assembly for firing an explosive charge underwater, comprising a sealed waterproof housing having a wall portion formed by a bellows element deformable in response to external pressure on the housing, a piezo-electric transducer element positioned within said housing so as to be compressible by the deformation of said bellows element, and an electric detonator having a fusehead electrically connected in circuit with said piezo-electric transducer element whereby said detonator is fired when the bellows element is sufficiently deformed by said external pressure to cause the said transducer element to generate the required voltage.

2. A device as claimed in claim 1 comprising an anvil element connected to the housing and a hammer element connected to the base of the bellows element, the piezo-electric element being positioned between said anvil element and said hammer element and having opposed faces adjacent respectively to the anvil element and the hammer element connected in circuit with the fusehead of the electric detonator.

3. A device as claimed in claim 2 wherein the said hammer element is positioned so that a predetermined deformation of the bellows, greater than any deformation resulting from normal handling, is required to compress the piezo-electric transducer element to a sufficient extent to fire the detonator.

4. A device as in claim 1 wherein the bellows element extends into the housing.

5. A device as in claim 4 wherein the bellows element is filled with a liquid.

* * * * *